United States Patent [19]

Horikoshi et al.

[11] Patent Number: 4,919,120

[45] Date of Patent: Apr. 24, 1990

[54] RADIANT-TYPE HEATER

[75] Inventors: Tadao Horikoshi, Tatebayashi; Hisao Naganuma, Ashikaga; Minoru Sugimoto, Iwafune; Masanobu Numao, Ashikaga, all of Japan

[73] Assignee: Sanyo Electric Co., Ltd., Osaka, Japan

[21] Appl. No.: 361,868

[22] Filed: Jun. 6, 1989

[30] Foreign Application Priority Data

| | | | |
|---|---|---|---|
| Jun. 9, 1988 | [JP] | Japan | 63-142435 |
| Jun. 10, 1988 | [JP] | Japan | 63-144038 |
| Jun. 10, 1988 | [JP] | Japan | 63-77649[U] |

[51] Int. Cl.[5] ..... F24C 5/00

[52] U.S. Cl. ..... 126/93; 126/92 B; 126/248

[58] Field of Search ..... 126/248, 92 B, 92 AC, 126/92 R, 92 C, 259 M, 93–96; 431/76, 315, 344

[56] References Cited

U.S. PATENT DOCUMENTS

| | | | |
|---|---|---|---|
| 1,196,019 | 8/1916 | Palmer | 126/248 |
| 4,488,536 | 12/1984 | Kojima et al. | 126/96 |
| 4,586,485 | 5/1986 | Koba et al. | 126/93 |
| 4,834,064 | 5/1989 | Takashima et al. | 126/96 |

FOREIGN PATENT DOCUMENTS

| | | | |
|---|---|---|---|
| 54-85538 | 7/1979 | Japan . | |
| 156125 | 9/1983 | Japan | 126/96 |
| 60-2415 | 1/1985 | Japan . | |
| 60-2420 | 1/1985 | Japan . | |
| 61-24819 | 7/1986 | Japan . | |

*Primary Examiner*—James C. Yeung

*Attorney, Agent, or Firm*—Wenderoth, Lind & Ponack

[57] ABSTRACT

A radiant-type heater is disclosed which has a deflection plate in an upper part of a casing, a burner in a lower part of the casing, and a heating element formed of a thin metal sheet. The heating element is suspended from the deflection plate downwardly towards the burner.

6 Claims, 6 Drawing Sheets

RADIANT-TYPE HEATER

BACKGROUND OF THE INVENTION

The present invention relates generally to a radiant-type heater and more particularly to a radiant-type kerosene flare heater or, in other words, primarily to a radiant-type kerosene heater for warming a room by forwardly radiating heat from a heating element heated by a burner in an exterior case.

Furthermore, the present invention provides a novel radiant-type kerosene flare heater which uses a rotary atomization type burner, a burner head having a unique horseshoe-shaped flame port to minimize carbon monoxide concentration and a heating element suspended inside a burner tube. The invention minimizes thermal capacity so as to reduce carbon monoxide concentration while maintaining radiation efficiency. It has a simple construction which makes it durable and aesthetically pleasing.

A variety of portable heaters have been employed in the home. Recently, radiant-type heaters which provide comfort and low noise have been considered as replacements for warm air blowing heaters, as disclosed in, for example, U.S. Pat. No. 4,488,536, which can easily maintain a uniform room temperature. This tendency is particularly remarkable in a cold area. The present invention provides a novel radiant-type kerosene flare heater which reveals the beauty of the flame. This feature has been neglected in the past but stresses a visual warmness which can be provided by a heating element having a simple structure.

A heater having a heating element which is heated by the flame of a burner is disclosed, for example, in Japanese Utility Model Publication No. 61-24819/1986. This red heat member comprises a cylindrically shaped metallic sheet such as a high chromium stainless steel and has a large number of through-holes bored therethrough in order to increase the degree of heating when the heating element is heated by the burner flame.

The conventional heating element described above is produced by rolling a metallic sheet into a cylindrical form, overlapping its end portions and connecting them together by spot-welding or a like method. The heating element thus produced is put onto the burner. When this heating element is subjected to the repetition of heating and cooling in the course of use of the heater, it cannot absorb the stress due to thermal expansion and thermal deformations such as local recesses, occur on a peripheral wall. Though this thermal deformation can be prevented by use of a thick metallic sheet, the thermal capacity of the heating element increases and the degree of heating drops if the thicker metallic sheet is used.

A combustion apparatus, for temporarily pre-mixing a gaseous fuel and primary air inside a burner body and jetting this fuel-air pre-mixture from a flame port of the burner head, is disclosed in Japanese Utility Model Publication Nos. 60-2415/1985 and 60-2420/1985. However, the former reference involves the drawbacks in that the structure of the burner body is complex because a secondary air pipe must be inserted through the burner body and such fitting of the secondary air pipe is time-consuming. The latter prior art publication also has the problem that the construction of the burner head is extremely complex because a secondary air passage must be formed in the burner head itself.

A heater equipped with a reflection plate which warms the room primarily by the radiant heat from a heat generation portion is disclosed, for example, in Japanese Patent Publication (unexamined) No. 54-85538/1979. According to this publication, both radiation heating and warm air blowing can be accomplished by providing a heat generation portion inside a main body case having an opening on its front surface, and also providing a blower between a reflection plate and the main body case. A heat shielding plate is disposed above the heat generation portion in order to prevent an upper tray of the main body case from being heated directly by the heat of the heat generation portion. However, when the heat generation portion produces high temperatures, the heated air stays in the space between the heat shielding plate and the upper tray and the temperature of the upper tray rises beyond a desirable level, thus causing various problems.

Combustion of a pre-mixture of fuel and air has been employed widely in kerosene heaters for home use because complete combustion can be obtained easily, the combustion flame is stable and a wide range of combustion is attained. In general, in combustion of such a pre-mixture, the kerosene is atomized and then vaporized by a heating surface and after being forcibly mixed with the primary air, is burnt by the burner head. Such pre-mixture combustion is classified into three type of systems: jet systems, rotary atomization systems and vaporization systems.

The rotary atomization system employed in the present invention has great advantages in that the kerosene fuel particles are very small and can be vaporized easily, the amount of the remaining fuel on the vaporization surface is small, even for a fuel having a high boiling point or for discolored kerosene, because the entire vaporization surface can be utilized by rotary atomization, the flame formation is stable and complete combustion can be obtained because the most desirable mixture of fuel and air is attained.

SUMMARY OF THE INVENTION

A main object of the present invention is to provide an improved radiant-type heater which eliminates various problems inherent in the prior art technique described above.

Another object of the present invention is to provide a radiant-type kerosene flare heater equipped with a heating element which can attain a desired radiation efficiency and maintain proper combustion.

A further object of the present invention is to provide a burner which is suitable for heating the heating element described above.

A still further object of the present invention is to provide a heating element which is excellent as to both aesthetics and durability.

Another object of the present invention is to provide a radiant-type kerosene flare heater capable of blowing out warm air, in addition to providing radiation heating.

A further object of the present invention is to provide a radiant-type kerosene flare heater capable of limiting the temperature rise within an upper part of an exterior case of the heater.

The radiant-type heater in accordance with the present invention comprises an exterior case having an opening on its front surface, a deflection plate disposed at the upper part of, and inside, this exterior case, a burner disposed at the lower part of, and inside, the exterior case and having a plurality of flame holes through which a fuel-air pre-mixture flows out, and a heating element made of a thin sheet and suspended from the deflection plate towards the burner.

In the construction described above, the portion of the burner immediately below the heating element and some portions of the burner outside the area below the heating element are preferably devoid of flame holes, whereas the remaining portions of the burner outside the area below the heating element have a plurality of flame holes.

Preferably, the heating element is formed of a belt-like thin sheet curved towards the opening on the front surface of the exterior case and having flanges on both of its sides.

In another preferred embodiment of the invention, the heater comprises an exterior case having a double-wall structure and an opening on its front surface, a deflection plate disposed at the upper part of, and inside, the exterior case, a burner disposed at the lower part of, and inside, the exterior case and having a plurality of flame holes through which a fuel-air mixture flows out, a heating element made of a thin sheet and suspended from the deflection plate towards the burner, a ventilation chamber defined inside a double wall of the exterior case, and a blower for sending air into the ventilation chamber, the ventilation chamber having an outlet at the upper part on the front surface of the exterior case.

In the construction described above, a plate member may be disposed in the ventilation chamber at the upper part of the exterior case for dividing an air stream from the blower to the outlet of the ventilation chamber.

In the present invention, the rotary atomization type burner is formed broadly with an air feed fan for sending primary air for combustion, a vaporization body for vaporizing kerosene to prepare a fuel-air pre-mixture and for burning the pre-mixture, a burner motor for rotating the air feed fan and a rotary diffusion plate, and a copper oil feed pipe. These elements are formed integrally to make the burner compact. The vaporization body is made of a highly heat-resistant cast iron and has a heater embedded in it. The vaporization body is heated by the heater to a necessary temperature for vaporization only at the time of ignition. The kerosene is turned into small particles (atomized) by the rotary diffusion plate. The interior of the vaporization body forms a vaporization wall, where the atomized kerosene is vaporized. The vaporized kerosene and the air are sufficiently mixed by the blades of the rotary diffusion plate. A burner head is disposed at the upper part of the vaporization body and a flame is formed on the burner head.

The burner operation is as follows. When the vaporization body is heated by the heater embedded therein to the temperature necessary for the vaporization of the kerosene, the burner motor starts operating and the air for combustion is sucked into the burner by the air feed fan. After the passage of a predetermined period of time, the oil feed pump starts operating and the kerosene is supplied from the oil feed pipe to the rotary diffusion plate. The kerosene is turned into the fine particles by the rotation of the diffusion plate, impinges against the vaporization wall and is rapidly vaporized. The high concentration of gas near the vaporization wall is sufficiently mixed with the air sent by the air feed fan by the blades of the rotary diffusion plate. This fuel-air mixture then reaches the burner head, by way of a fuel-air mixture rectification plate, where it is ignited so as to form a combustion flame. Thereafter, this flame heats the upper part of the vaporization body and the heat is fed back to maintain the temperature of the vaporization wall.

The vertical rotary atomization mechanism of the present invention eliminates certain drawbacks of the conventional mechanisms such as oil leakage due to insufficient adjustment of a gap between the oil feed pipe and a rotary conical member, and it improves the performance of rotary atomization.

In the conventional mechanisms, the fuel must be transferred from the oil feed pipe to the rotary conical member in order to rotate and atomize the fuel, and the gap between them must be adjusted to a predetermined range of from 0.3 mm to 0.5 mm. If this gap is smaller than the range, the oil feed pressure rises with the result that the fuel supply quantity drops and a noise occurs as the rotary conical member and the oil feed pipe come into mutual contact. If the gap is larger than the above-described range or if the rotary conical member deviates from its center of rotation, the fuel cannot be supplied properly, thus causing leakage of the fuel through the gap and along the oil feed pipe, and so called "intermittent combustion".

In accordance with the structure of the present invention, the oil feed pipe is welded to a metal oil pan having an escape hole and a rotary shaft through its center. The metal oil pan is positioned inside the vaporization body in order to provide the fuel to the rotary diffusion plate by utilizing the discharge force of the oil feed pipe. The characterizing feature of this structure lies in that even if the fuel does not move to the rotary diffusion plate, it drops onto the bottom surface of the vaporization body along the metal oil pan and is vaporized to thereby prevent oil leakage. Since the discharge force of the oil feed pipe is utilized and the area of the oil pan surface is large, the gap in the structure in the present invention can be made larger and even when it is increased to from 0.5 to 4.0 mm, oil leakage does not occur. Accordingly, assembly and adjustment is less difficult than in the conventional mechanisms.

Next, the structure of the burner head of the present invention will be explained. In constructing the burner head, it is customary to determine the flame hole area so that the combustion rate of the fuel is in equilibrium with the flow rate of the fuel-air pre-mixture. A flame hole load ratio, expressed by the formula below, is used as a parameter of flame hole load performance.

$$\text{flame hole load ratio} = \left(\text{combustion quantity per unit time}\right) \div \text{flame port area}$$

It is known empirically that in the case of kerosene, the combustion rate and the flow rate of the pre-mixture are substantially in equilibrium with each other if this flame hole load ratio is set to approximately 5 Kcal/h·mm$^2$. Recently, however, burners having a greater adjustment range of the combustion quantity have been required. Thus, the flame port load ratio must vary between a maximum combustion quantity and a minimum combustion quantity. Therefore, the burner of this invention, too, has a ratio of about 6 Kcal/h·mm$^2$ at the time of the maximum combustion and about 2.5 Kcal/h·mm$^2$ at the time of the minimum combustion.

The inner flame length of the flame is expressed by the following formula:

$$L \alpha DV/\lambda$$

where L: inner flame length,

D: flame hole diameter,

V: jet speed of pre-mixture, $\alpha$: combustion rate of pre-mixture.

Here, the combustion rate is the value obtained by measuring the flow rate and the inner flame height and dividing the flow rate by the surface area of the inner flame by regarding the inner flame as a conical member. The combustion rate of the pre-mixture of gas changes with a proportion of the primary air for combustion. Generally, in the case of forced mixing, the mixing state of the air for combustion and the vaporized gas determines the shape of the inner flame.

In the burner head of the present invention, the flame port is formed with a group of small round holes in order to reduce the noise and to enlarge the adjustment range of the combustion quantity. An emphasis is put on the formation of an elongated flame to thereby heat the heating element positioned above the burner. Accordingly, secondary combustion air is taken in by natural draft so as to prevent flickering of the flame and ensure brightness of the heating element.

Furthermore, reduction of carbon monoxide is desirable in order to improve safety. In an early embodiment of the invention, the small holes of the burner head were formed along a ring-shaped area of the burner, but it was found that carbon monoxide was generated when an air-feed insufficiency test was conducted. Accordingly, the holes along part of the ring-shaped area were removed. Since no flame was formed at this cut-off portion and fresh air was sucked from outside into the center of the flame by air draft, the generation of carbon monoxide was reduced.

Next, the heating element of the present invention will be explained.

In order to properly form the burner flame, the primary combustion air must be set to an air ratio of from about 0.5 to about 1.0 depending on the characteristics of the primary burner. However, since a large amount of carbon monoxide is generated in that region, secondary combustion by the secondary air combustion becomes necessary. The observation of the burner flame reveals that the inner flame is formed by the primary combustion air and the outer flame is formed substantially gathered about the inner flame. Carbon monoxide is present inside the outer flame because the gas remains unburnt inside the outer flame. Carbon monoxide, however, is not detected where the outer flame and the secondary combustion air come into contact because complete combustion takes place where this occurs.

At the elongated tip of the outer flame, however, there is too much air present, the flame temperature drops and the unburnt component causes a trace amount of carbon monoxide to be present. If a horizontal deflection plate is inserted into the tip of this outer flame, the tip of the flame is offset in the horizontal direction and contacted with the secondary air for combustion. The deflection plate also serves as a temperature retention plate to accomplish full combustion. The results of experiments revealed that this arrangement of the burner most restricts the generation of carbon monoxide.

At the first stage of the experiments, 30 kinds of heating elements of different shape and size were produced and put into the outer flame, but carbon monoxide was generated irrespective of the shape and size of the heating element.

However, it was noted that the generation of carbon monoxide was less when the thickness of the heating element was small. It is assumed, therefore, that the heating element serves not only as a heat radiation member but also as a cooler for the flame. In other words, when the heating element is put into the flame, it absorbs the heat necessary for the combustion so that the unburnt gas does not react and carbon monoxide is generated. It was thus concluded that a heating element having a minimum possible thermal capacity is suitable for limiting carbon monoxide.

In deciding the shape of the heating element, other factors such as uniformity of red-heat, brightness, thermal deformation, etc., were taken into consideration. A semi-cylindrical shape was found most suitable.

Next, experiments were carried out to determine the most desirable position for the heating element to be suspended inside the combustion cylinder. When the heating element was positioned at the end of the outer flame, less red-heat was produced and the flame temperature dropped where it came into contact with the secondary combustion air. Thus, the combustion reaction was not complete and a greater amount of carbon monoxide was generated. The amount of carbon monoxide generated was the smallest when the heating element was disposed at the rear of the flame because the notch portion of the burner head existed at the rear of the flame and the heating element was offset from the outer portion of the flame. The red-heat was greatest when the heating element was suspended from a deflection plate portion of the exhaust gas rectification plate to the center of the outer flame, and it was found that the generation of carbon monoxide was quite low. This seems to be based upon the fact that the temperature was high at the center of the outer flame so that the heating element was heated to read heat. Since the heating element was also serving as a cooler, combustion became incomplete and carbon monoxide was generated. It is assumed that since the outer part of the heating element was wrapped by the flame, the combustion reaction was gradually completed as the carbon monoxide moved progressively in the outer peripheral direction of the flame. Consequently the generation of carbon monoxide was reduced.

As the result of experiments described above, the heating element in the present invention has a sheet-like form to reduce its thermal capacity and it is positioned at the center of the outer flame. It is bent at both of its ends to improve its resistance to thermal deformation and is molded semicylindrically so that it can be arranged to appear as being fully cylindrical. A ferrite type heat-resistant stainless steel SUH-21 (18 Cr-3 Al steel), which is preferably 0.3 mm thick, is used as the material for the heating element. Since this stainless steel has high chrominum and aluminum contents, it is highly acid-resistant. When used for the heating element, which is subject to the repetition of heating and cooling, it provides an excellent heat-resistant and acid-resistant steel which is resistant to scaling.

DESCRIPTION OF THE PREFERRED EMBODIMENTS

Hereinafter, preferred embodiments of the present invention will be described with reference to the accompanying drawings.

Figure 1:
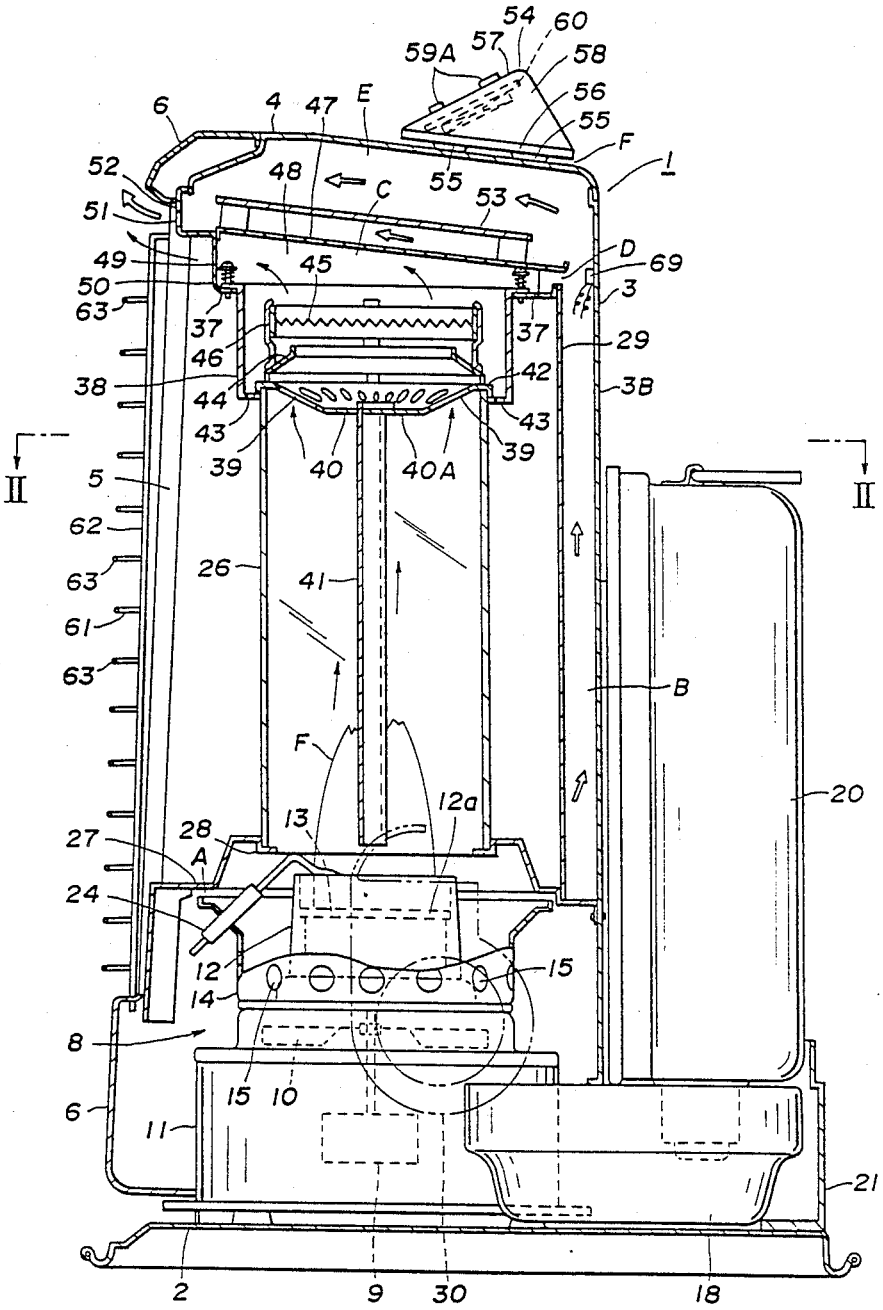
FIG. 1 is a partly sectioned elevation view of a heater embodying the present invention.
Figure 2:
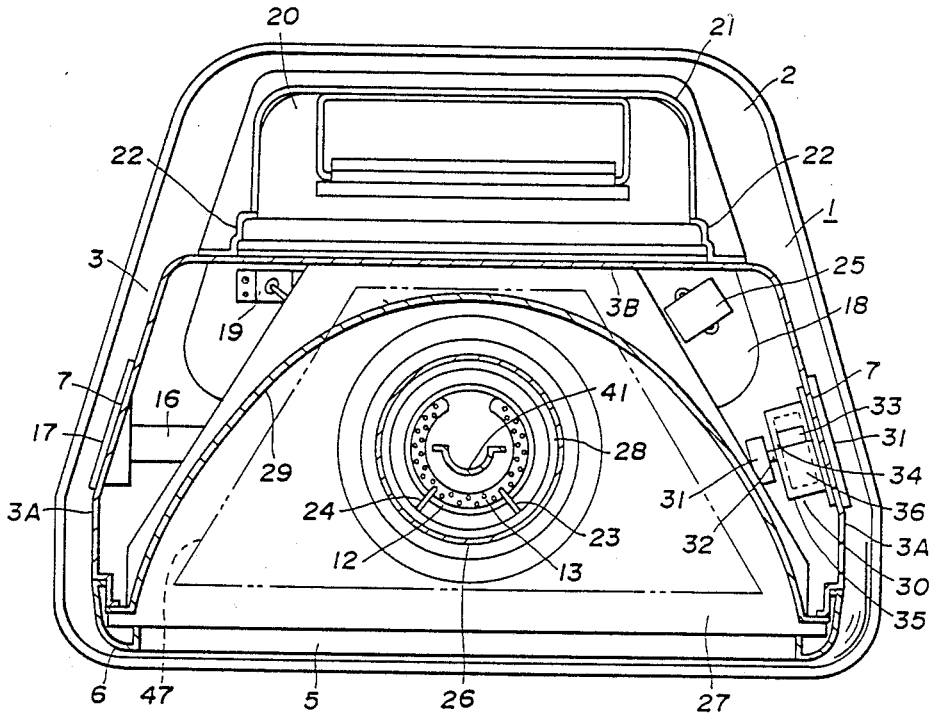
FIG. 2 is a sectional view taken along line II—II in FIG. 1, FIGS. 3A and 3B are perspective view and plan view, respectively, of a heating element employed in the heater of the present invention.

In FIGS. 1 to 6, a main body case 1 includes a bottom plate 2 as a bed, a peripheral side plate 3, an upper tray 4 and a front panel 6 having an opening 5. As shown in FIG. 2, the peripheral side plate 3 is formed by bending a single metal sheet so as to integrally form right and left side sheet portions 3A, a back sheet portion 3B, and inclined portions 7 formed as part of the side sheet portions 3A and 3B in such a manner that they converge towards the back sheet portion 3B.

A burner device 8 is placed and fixed onto the bottom plate 2 and includes a motor 9 and an air feed case 11 with a built-in air feed fan 10 that is rotated by the motor 9. A cylindrical burner 12 for vaporizing and burning a kerosene fuel is disposed on the air feed case 11. The fuel vaporized in this burner 12 is mixed with combustion air from the air feed fan 10, jetted from a flame port portion 13 of a burner head 12*a* and burnt while forming a blue flame F above this flame port portion 13. A cylindrical burner case 14 is disposed at the upper part of the air feed case 11 in such a manner as to encompass the burner 12. A plurality of secondary air holes 15 are bored in the peripheral wall of the burner case 14 so as to introduce the secondary air into the burner case 14. The air feed case 11 has an air feed duct 16 and supplies room air as the combustion air into the air feed case through a filter 17. An oil 18 is fixed onto the bottom plate 2 at the rear part of the burner device 8. A preferred embodiment of the burner device 8 and its peripheral structures will be explained subsequently with reference to FIG. 7.

The rear part of the oil pan 18 projects outward from the back sheet portion 3B of the peripheral side plate 2 and its front part partially encircles a rear portion of the air feed case 11. A fuel feed pump 19 such as an electromagnetic pump is disposed to suck up the fuel in the oil pan 18 and to supply it to the burner 12. A cartridge-type tank 20 is mounted to the external part of the main body case 1 and supplies the fuel into the oil pan 18. The cartridge-type tank 20 is removably supported by a tank guide 22 formed integrally with the upper part of a tank cover 21 which covers the periphery of the oil pan 18. A spark plug 23 and a flame sensor 24 are supported by the burner case 14 and penetrate into the burner 12. A high voltage from a spark transformer fixed onto the oil pan 18 is applied to the spark plug 23.

A burner tube 26 which defines a heat generation element is disposed inside the main body case 1 in such a manner that it can be viewed through the opening 5 in the front panel 6. This burner tube 26 acts as a combustion cylinder and is shaped from heat-resistant transparent glass into a hollow cylindrical form so that the flame F of the burner 12 is caused to rise within the lower part of the burner tube 26. A partition 27 which functions also as a horizontal reflection plate is disposed in such a manner as to vertically separate the interior of the main body case 1. The rear edge of partition 27 is fixed to the back sheet portion 3B of the side plate. As shown in FIG. 2, its right and left side edges are spaced inwardly from the inner surface of the side sheet portion 3A of the peripheral side plate 3. A lower support portion 28 is provided substantially at the center of the partition 27 to receive and support the lower end of the burner tube 26. A gap A of from about 5 to about 10 mm is defined between the lower surface of the partition 27 and the burner case 14 (FIG. 1). An arcuate reflection plate 29, as viewed in FIG. 1, is disposed at the rear part of the burner tube 26 and its lower end is fixed to the partition 27 by spot-welding or the like and integrally combined with the partition 27. A space b whose lower end communicates with the space below the partition 27 is defined between the reflection plate 29 and the peripheral side plate 3.

A heat recovery blower, generally represented by reference numeral 30, accelerates the room air sucked through the filter 31 and sends it into the space B. It consists mainly of a driving motor 31, a Silocco fan 33 which produces a light wind, is fixed to the motor shaft and has a diameter of about 60 to about 80 mm, and a fan case 25 whose blast port 34 opens upward. A guide plate 36 is disposed in the fan case 35 in order to guide part of the wind blown out upwardly from the blast port 34 to the side direction.

An upper reflection plate 37 is disposed at the upper end of the reflection plate 29 and an exhaust tube 38 penetrates through this upper reflection plate 37 in such a manner as to be capable of moving up and down. An exhaust gas rectification plate 40 having a deflection plate portion 40A is connected to the bottom of the exhaust tube 38 and has a large number of exhaust ports 39, and the upper end of a heating element 41 which is suspended substantially at the center inside the burner tube 26 is fixed to the exhaust gas rectification plate 40 in such a manner that the heating element 41 is suspended from the deflection plate portion 40A.

The heating element 41 is produced by press working a high chromium stainless steel sheet (SUH-21) having a thickness of about 0.3–0.5 mm. The heating element 41 has, disposed at its center, a curved portion 71 with a substantially U-shaped cross-section which opens rearwardly away from the opening 5. Flat flanges 72 extend outwardly from the right and left sides of this curved portion 71. These flanges 72 are disposed so as to extend along the entire length of the curved portion. Fitting tabs 73 are integrally formed by bending the upper ends of the flanges 72 and the curved portion 71. In the present invention, the heating element 41 is suspended from the deflection plate 40A inside the combustion cylinder 26 by fixing the fitting tabs 73 to substantially the center of the deflection plate portion 40A inside the burner tube 26, its lower end is disposed near the burner 8, comes into contact with the internal flame of the flame F of the burner 8 and is red heated. As shown in FIG. 3D, the heating element 41 is disposed in such a manner that it is positioned inside the horseshoe flame port portion 13 disposed in the burner head 12*a* and comes into contact with the internal flame while being wrapped by the flame F.

Figure 3A:
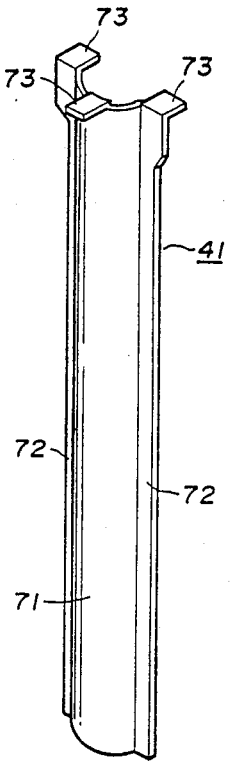
FIG. 3C is a plan view of a heating element in accordance with another embodiment of the invention.
FIG. 3D is a diagram showing the position of the heating element.
Figure 3B:
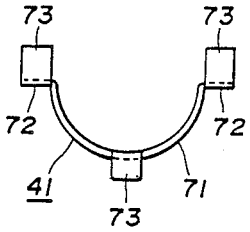
Figure 3C:
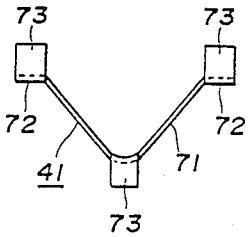
Figure 3D:
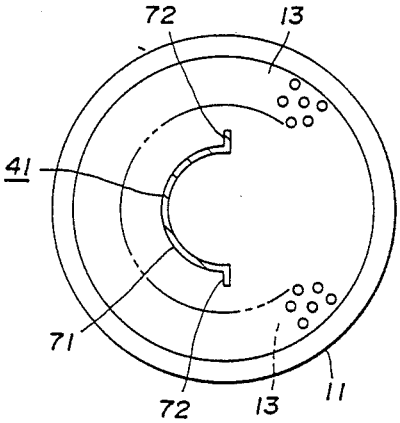
Figure 4:
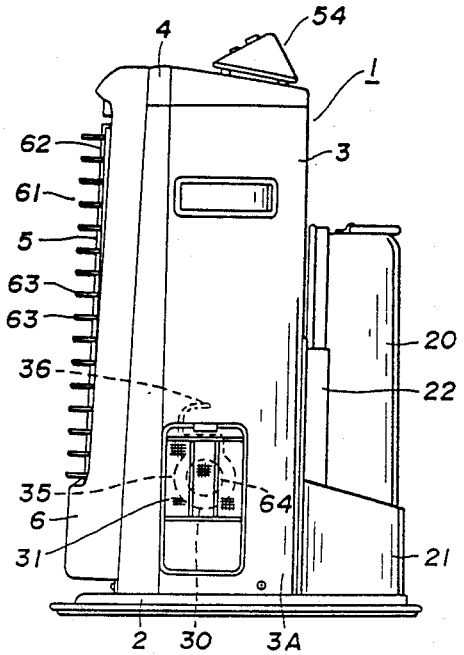
FIG. 4 is a side view of the heater according to the present invention.
Figure 5:
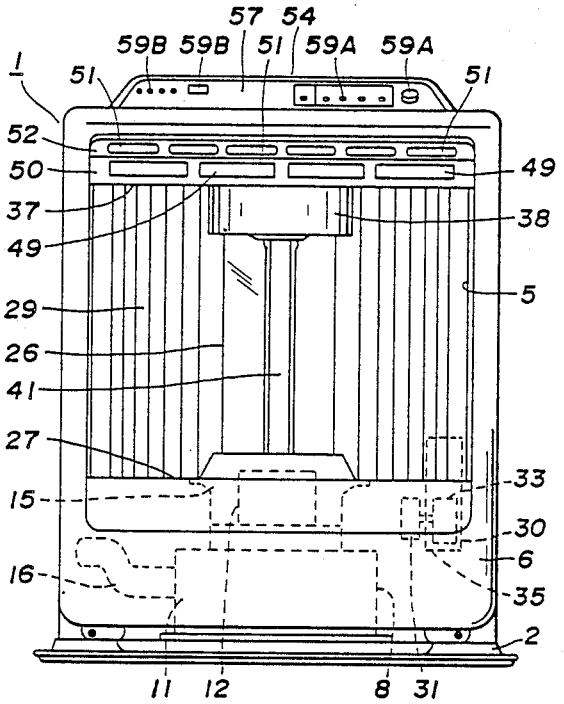
FIGS. 5 and 6 are front view and top plan view, respectively, of the heater shown in FIG. 4, with protective net being removed for simplification.

Though the curved portion of the heating element 41 in this embodiment has a substantially U-shaped cross-section, it may have a substantially V-shaped cross-section as shown in FIG. 3C, in which similar parts are designated by the same reference numerals, and no further description will be set forth.

Figure 1A:
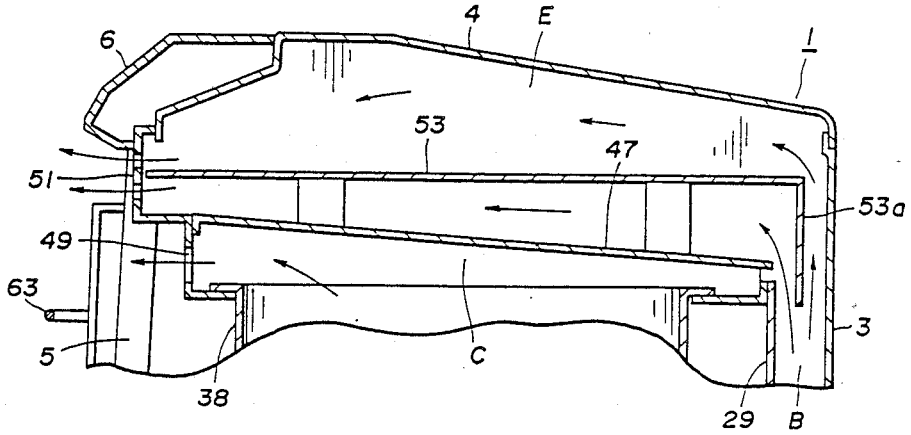
FIG. 1A is an enlarged sectional view of a part of the heater according to another embodiment of the invention.

A heat shielding plate 47 is disposed above the burner tube 26 in such a manner as to be inclined progressively upwardly towards the opening 5 of the front surface, and is fixed onto the upper reflection plate 37 by suspension plates, one of which is shown at 48, at both its right and left side portions. An exhaust chamber C which includes the interior of the exhaust tube 38 and communicates with the interior of the combustion cylinder 26 through the exhaust tube 38 is formed below this heat shielding plate 47. A plurality of outlets 49 at the front edge of the exhaust chamber C are formed on a lower bent plate 50 formed by bending the front edge of the upper reflection plate 37, and a small gap D for communication of the exhaust chamber C with the upper end portion of the space B is disposed between the rear end portion of the heat shielding plate 47 and the upper reflection plate 37. An abnormal temperature sensor 69 for interrupting operation of the heater upon occurrence of an abnormal rise in temperature is disposed adjacent the small gap D. A ventilating chamber E communicating with the space B is defined between the upper surface of the heat shielding plate 47 and the main body case 1. A plurality of outlets at the front end of this ventilating chamber are defined in the upper bent plate 52 formed as a continuation of the lower bent plate 50 described above. The outlets 49 of the exhaust chamber C are disposed below the outlets 51 of the ventilating chamber E and inwardly of the outlet 51 by about 15 to about 30 mm. An auxiliary heat shielding plate 53 is disposed above the heat shielding plate 47. The auxiliary shielding plate 53 can be formed in such a manner that it has a vertical plate 53*a* projecting downward to the space B, as illustrated in FIG. 1A, so as to provide a more reliable separation of ventilation. FIG. 1A also shows that the auxiliary shielding plate 53 can be disposed in a horizontal arrangement as illustrated.

An operation unit 54 is fitted onto the upper part of the upper tray 4 with a gap F of about 2 to about 5 mm between them. Projections 55 are disposed in order to define such a gap F and part of the lower surface plate 56 of the operation unit 54 projects downward. The front surface portion of the operation unit, represented by reference numeral 57, is inclined upwardly towards an upper box 58 made of a synthetic resin. The front surface portion 57 has various kinds of operation buttons, generally illustrated at 59A, and an indicator 59B. Reference numeral 60 represents a circuit board of the operation unit which is incorporated in the operation unit 54. Reference numeral 61 represents a protection guard disposed at the opening 5 described above. The protection guard 61 has right and left fixing rods 62 and a plurality of transverse rods 63 whose ends are each fixed to the fixing rods 62. The uppermost transverse rod 63 is disposed at a position below the outlet 49 of the exhaust chamber C so that it cannot be heated easily be the exhaust gas.

Figure 6:
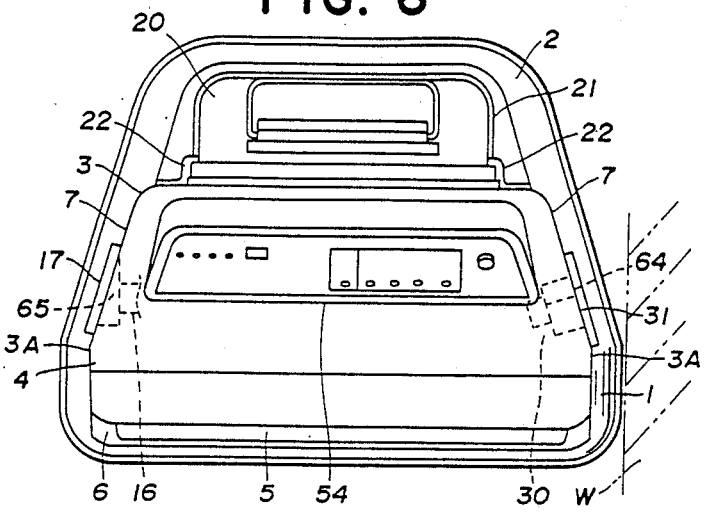

The suction port 64 of the heat recovery blower 30 covered by the filter 31 and the air supply port 65 of the air supply duct 16 covered by the air supply filter 17 open along the inclined portions 7 of the side plate portions 3A of the peripheral side plate 3, respectively, as shown in FIG. 6, so that even when the heater is placed near the wall W of the room, a sufficient distance is maintained between the heater and the wall surface.

In the operation of the above-described heater construction, the burner device 8 is first driven and the air feed fan 10 is rotated by the operation of the motor to suck the combustion air into the burner 12 as the primary air. Part of the air inside the air feed case 11 is emitted as the secondary air into the main body case 1 below the partition 27. The primary air supplied into the burner 12 is pre-mixed with the vaporized gas of the kerosene fuel that is supplied into and vaporized inside the burner 12. This air-fuel pre-mixture is jetted from the flame port portion 13 into the burner tube 26, ignited by the spark plug 23 and burnt to form the blue flame F. Upon actuation of the burner device 8, the flame F and the high temperature combustion gas heat the heating element 41 to red heat. The combustion exhaust gas flows into the exhaust chamber C through the exhaust passage holes 39 of the exhaust gas rectification plate 40, then passes through the exhaust gas guide plate 44 and a catalyst 45 and is discharged from the outlet 49 of the exhaust chamber C.

Next, the burner device and its peripheral structures will be described with reference to FIGS. 7 to 10.

Figure 7:
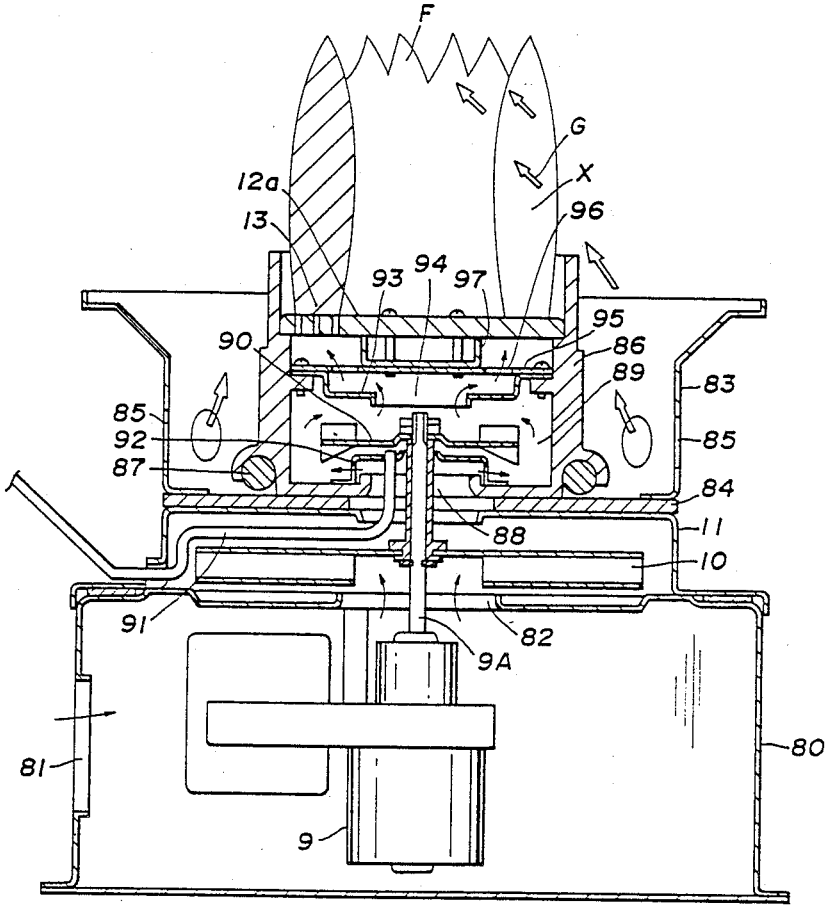
FIG. 7 is a sectional elevation view of a combustion apparatus according to the present invention.

In FIG. 7, a cylindrical motor case 80 has an air feed port 81 at a suitable position on its side wall which communicates with the air feed case 11 through a ventilation port 82. A burner case 83 is separated from the air feed case 11 by a heat insulating material 84. A plurality of air ports 85 are formed through the side wall of the burner case along a substantial portion of its periphery. The motor case 80, air feed case 11 and burner case 83 are connected in the mentioned order. The feed fan 10 of a turbo fan is fitted to the intermediate part of the motor shaft 9*a* of the motor disposed in the motor case 80 inside the air feed case 11.

A cylindrical burner body 86 having a bottom is disposed substantially at the center of the inside of the burner case 83 and has vaporization heater 87 buried in its peripheral wall. The burner body 86 is interconnected to the air feed case 11 through the heat insulating material 84. A primary air inlet 88 is disposed substantially at the center of the bottom of this burner body 86 and a vaporization pre-mixing chamber 89 is defined inside the burner body 86.

A stirring plate 90 which functions also as a fuel scattering plate inside the vaporization pre-mixing chamber 89 is fixed to the tip of the motor shaft 9A. Fuel is supplied to this stirring plate 90 from a fuel supply pipe 91 which enters the vaporization pre-mixing chamber 89 through the secondary air inlet 15 and the primary air inlet 88. A metal fixing plate 92 is disposed in the vaporization pre-mixing chamber 89 near the primary air inlet 88. The fixing plate 92 supports the outlet portion of the fuel supply pipe 91 and prevents the fuel from leaking outside the vaporization pre-mixing chamber through this fuel supply pipe. A rectification plate 95 is equipped at its center with a plurality of through-holes 96 positioned radially outwardly from a throttle port 94, formed in a throttle plate 93, and a cylindrical support 97. The cylindrical support 97 has a bottom which is fixed to the center of the upper surface of this rectification plate 95. The throttle plate 93, the rectification plate 95 and the support cylinder 97 are disposed in the burner body 86 in the mentioned order.

Figure 8:
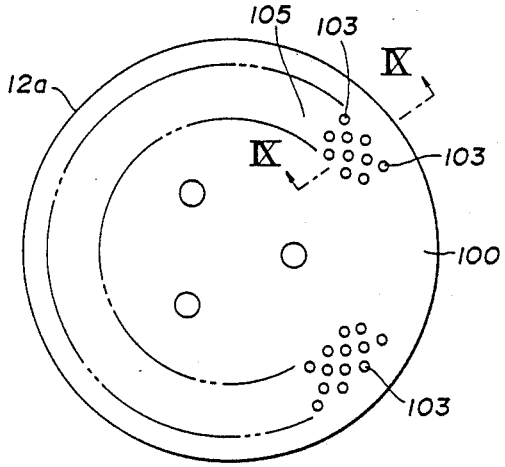
FIG. 8 is a plan view of a burner head for the combustion apparatus shown in FIG. 7.
Figure 9:
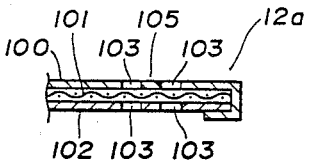
FIG. 9 is a sectional view taken along line IX—IX in FIG. 8.

The burner head 12*a* is fitted within the burner body 86 adjacent its tip opening and consists mainly of a head main plate 100, a metal net 101 and a head sub-plate 102 superposed one upon another from above to below in the mentioned order. As shown in FIG. 8, the burner head 12*a* has a flame port portion 105 of a horseshoe shape defined by a large number of small round holes 103. The center and part of the outer peripheral portion of the burner head 12*a* do not include the small round holes. The diameter of each of these small round holes is about 1.8 mm to about 2.0 mm.

In the construction described above, when a current is applied to the vaporization heater 87, the burner body 86 is heated, and when its temperature reaches the vaporization temperature of the kerosene, the burner temperature sensor (not shown) senses the temperature and the motor 9 is actuated such that the air feed fan 10 and the stirring plate 90 start rotating. After the motor 9 begins operating, the fuel pump (not shown) starts operating and the kerosene is supplied from the fuel supply pipe 91 to the lower surface of the rotating stirring plate 90. The fuel supplied to the stirring plate 90 is scattered in by the centrifugal force and deposits fine particles of fuel (i.e. atomized fuel) onto the inner peripheral wall of the heated burner body 86. The atomized fuel is vaporized instantaneously in the vaporization pre-mixing chamber.

The fuel and the primary air are supplied from the air feed fan 10 into the vaporization pre-mixing chamber 89 through the primary air port 88, and the gaseous fuel is pre-mixed with the primary air by the stirring plate 90 inside the vaporization pre-mixing chamber 89. The resulting fuel-air pre-mixture is jetted through the throttle port 94, through the through-hole 96 and through the small round holes 103 of the flame port portion 13*a* of the burner head 12*a*, is ignited by the spark plug (not shown) and is burnt as a blue flame while forming the flame F above the flame port portion 13.

Figure 10:
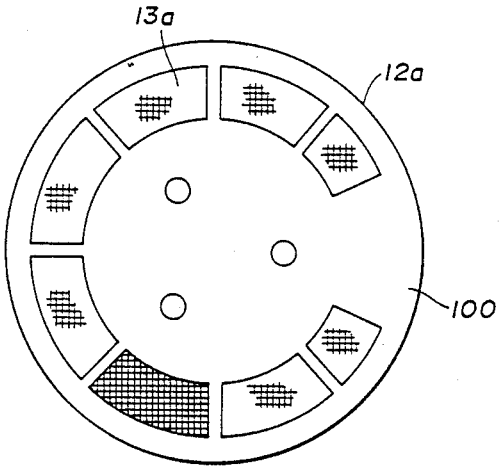
FIG. 10 is a plan view of a burner head according to another embodiment of the invention.

Since the flame port portion 13 of the burner head 12*a* is shaped in the form of a horseshoe in the present invention, the flame F extending cylindrically upward is formed at the flame port portion 13 and a non-flame space X having a predetermined width is formed in the flame F about its periphery. Moreover, since the center of this flame F is subject to a negative pressure due to the draft action resulting from ascending movement of the combustion gas, the secondary air is sucked and supplied to the center of the flame F from the non-flame space X as indicated by arrow G in FIG. 7. Accordingly, the secondary air can be supplied to the center of the flame by natural ventilation due to the (carbon monoxide) can be minimized while combustion noise due to the supply of the secondary air is reduced. Furthermore, the present invention can simplify the construction because it does not require a complicated structure such as one wherein the secondary air pipe penetrates through the burner body or one wherein the secondary air passage is formed in the burner head. If the diameter of the small round hole 103 forming the flame port portion 13 is set to 2 mm or below, the metal net 101 for preventing back-fire does not become red-heated and the durability of the burner head 12*a* is drastically improved. The horseshoe-shaped flame port portion 13 can be formed by 6 to 10 fan-shaped openings 13*a* as shown in FIG. 10.

When the burner device 8 starts combustion, the flame F and the high temperature combustion gas red-heats the heating elements 41 and the combustion exhaust gas is discharged from the outlet of the exhaust chamber C, as already described. On the other hand, when the flame sensor 24 senses the existence of the flame F, the heat recovery blower 30 operates and the room air sucked into the fan case 35 by the Silocco fan 33 through the filter 31 is discharged to the lower end portion of the space B from the blast port 34. The air stream of the light wind flowing into this space B rises inside the space while recovering the heat of the reflection plate 29 heated by the radiation heat of the combustion cylinder 36, and a small portion of the air stream enters the exhaust chamber C from the small gap D while its major portion flows into the ventilation chamber E and is emitted from its outlet 51.

According to the embodiment described above, the ventilation chamber E is defined between the heat shielding plate 47 disposed at the upper part of the burner tube 26 and the upper tray 4 of the main body case 1, and the air of the blower 30 for blowing the air into the space B between the reflection plate 29 and the main body case 1 is caused to flow through the ventilation chamber E. Accordingly, the air from blower 30 recovers the heat of the reflection plate 29 and heat shielding plate 47, which are heated to a high temperature, and emits the heat into the room. Therefore, the heating effect is improved and the temperature rise of the peripheral side plate 3 and the upper tray 4 is checked efficiently.

The exhaust chamber C communicating with the burner tube 26 is formed below the heat shielding plate 47 and the temperature of the exhaust gas discharged from the outlet 49 of this exhaust chamber C is lowered by the air stream emitted from the outlet 51 of the ventilation chamber E. It is therefore possible to check the temperature rise at the upper end portion of the front panel 6 due to contact of the exhaust gas and thus avoid injuries caused by burns. Moreover, since the outlet 49 of the exhaust chamber C is positioned inwardly from the outlet 51 of the ventilation chamber E, there is less of a chance that people will touch the outlet portion 49 of the exhaust chamber C which is heated to a high temperature.

According to the present invention, the suspended heating element 41 is formed by a sheet which has a curved portion 71 facing the opening 5 of the heater. Accordingly, the stress due to thermal expansion at the time of heating can be absorbed by the deflection of the curved portion 71 so that the heating element does not undergo thermal deformation and does not become recessed. Thermal deformation can thus be prevented and the structure of the heating element 41 can be simplified because it is not necessary to form the heating element as a cylinder. The flange portions 72 at both ends of the curved portion enlarge the red heated surface and insure heat radiation over a greater area so as to improve the heating effect.

What is claimed is:

1. A radiant-type heater comprising:

an exterior case having an opening in a front surface thereof, an upper space defined in an upper portion of the case and a lower space defined in a lower portion of the case;

a deflection plate mounted in said upper space;

a burner mounted in said lower space and having a plurality of flame holes formed therein adapter to have a fuel-air mixture flow therethrough; and a heating element suspended downwardly from said deflection plate toward said burner, said heating element including a curved portion with a concave side and a convex side, said convex side of said curved portion of said heating element facing said opening in said front surface of said exterior case.

2. A radiant type heater according to claim 1, wherein said burner comprises a burner head through which said plurality of flame holes are formed, and said burner head includes a first surface portion, located directly beneath said heating element, which is devoid of flame holes, a second surface portion, located outside said first surface portion, which has said plurality of flame holes formed therethrough, and a third surface portion, located outside said first surface portion and adjacent said second surface portion, which is devoid of flame holes.

3. A radiant type heater according to claim 1, wherein said heating element further includes two flange portions extending outwardly from respective sides of said curved portion.

4. A radiant type heater comprising:

a double-walled exterior case having an opening in a front surface thereof, an upper space defined in an upper portion of the case, and a lower space defined in a lower portion of the case, said double-walled case being formed of an exterior wall, an interior wall, and a first ventilation chamber defined between said exterior and interior walls;

a deflection plate mounted in said upper space;

a burner mounted in said lower space and having a plurality of flame holes formed therein adapted to have a fuel-air mixture flow therethrough;

a heating element suspended downwardly from said deflection plate toward said burner;

blower means for forcing air through said first ventilation chamber; and a heat shielding plate, supported above said deflection plate, for defining thereabove a second ventilation chamber which is in fluid communication with said first ventilation chamber and which has an outlet through said front surface of said exterior case above said opening in said front surface of said case, and for defining therebelow an exhaust chamber having an outlet through said front surface of said exterior case above said opening but below said outlet of said second ventilation chamber;

said outlet of said exhaust chamber being positioned rearwardly of said outlet of said second ventilation chamber.

5. A radiant-type heater comprising:

an exterior case having an opening in a front surface thereof, an upper space defined in an upper portion of the case and a lower space defined in a lower portion of the case;

a deflection plate mounted in said upper space;

a burner mounted in said lower space and comprising a burner head through which a plurality of flame holes are formed an adapted to have a fuel-air mixture flow therethrough; and a heating element suspended downwardly from said deflection plate toward said burner;

said burner head including a first surface portion, located directly beneath said heating element, which is devoid of flame holes, a second surface portion, located outside said first surface portion, which has said plurality of flame holes formed therethrough, and a third surface portion, located outside said first surface portion and adjacent said second surface portion, which is devoid of flame holes.

6. A radiant-type heater comprising:

an exterior case having an opening in a front surface thereof, an upper space defined in an upper portion of the case and a lower space defined in a lower portion of the case;

a deflection plate mounted in said upper space;

a burner mounted in said lower space and having a plurality of flame holes formed therein adapted to have a fuel-air mixture flow therethrough; and a heating element suspended downwardly from said deflection plate toward said burner, and comprising a narrow elongated thin sheet with an outwardly curved portion protruding toward said opening in said front surface of said case and flanges extending outwardly from respective longitudinal edges of said curved portion.

* * * * *